US005111777A

United States Patent [19]

Steinberg et al.

[11] Patent Number: 5,111,777

[45] Date of Patent: May 12, 1992

[54] EVAPORATION COOLING SYSTEM FOR A LIQUID-COOLED INTERNAL-COMBUSTION ENGINE

[75] Inventors: Peter Steinberg, Maitenbeth; Peter Kinninger, Rosenheim, both of Fed. Rep. of Germany

[73] Assignee: Bayerische Motoren Werke AG, Fed. Rep. of Germany

[21] Appl. No.: 642,431

[22] Filed: Jan. 17, 1991

[30] Foreign Application Priority Data

Jan. 17, 1990 [DE] Fed. Rep. of Germany ..... 4001208

[51] Int. Cl.[5] ..... F01P 3/22

[52] U.S. Cl. ..... 123/41.54; 123/41.21

[58] Field of Search ..... 123/41.20, 41.21, 41.24, 123/41.27, 41.25, 41.54, 41.03

[56] References Cited

U.S. PATENT DOCUMENTS 4,273,563 6/1981 Fadda et al. ..... 123/41.54
4,367,699 1/1983 Evans ..... 123/41.21

FOREIGN PATENT DOCUMENTS 0295445 12/1988 European Pat. Off. .
3712122A1 10/1987 Fed. Rep. of Germany .
1245326 9/1960 France ..... 123/41.54

*Primary Examiner*—Noah P. Kamen
*Attorney, Agent, or Firm*—Evenson, Wands, Edwards, Lenahan and McKeown

[57] ABSTRACT

An evaporation cooling system for an internal-combustion engine controls venting through a valve as a function of the temperature. The escape of water vapor is prevented when the vent valve is not yet actuated.

26 Claims, 3 Drawing Sheets

EVAPORATION COOLING SYSTEM FOR A LIQUID-COOLED INTERNAL-COMBUSTION ENGINE

BACKGROUND OF THE INVENTION

The present invention relates to an evaporative cooling system for a liquid-cooled internal-combustion engine. More particularly, the invention is directed to a system having a coolant jacket filled completely with coolant, a vapor separator in the forward-flow line to the condenser, a condensate pump arranged in the return flow line from the condenser to the cooling jacket, and a connecting line from the vapor separator parallel to the condenser to the return flow line with an expansion tank connected to the vapor space of the condenser.

From *Motortechnische Zeitschrift* (MTZ) No. 50 (1989), Volume 9, Page 428, an evaporation cooling system is known which has the advantage that an increased operating temperature may be obtained at partial load but that, at high load, the same efficiency is reached as in a conventional cooling system.

In this known evaporation cooling system which, in a cold condition, is filled only partially with coolant, a closed expansion tank with a variable volume is provided for venting purposes. However, this tank requires additional installation space. Also, additional measures must be provided in order to fill this evaporation cooling system with the coolant.

It is, therefore, an object of the present invention to provide an evaporation cooling system in which additional installation space for an expansion tank is not required.

This object has been achieved in accordance with the present invention by connecting the expansion tank to atmosphere when the coolant is cold and, at the operating temperature of the coolant, disconnecting the expansion tank from the atmosphere. The solution is based on the basic recognition that a connection should be established between the cooling system and the atmosphere as a function of the temperature. In this case, the connection to the atmosphere is maintained until it is ensured that no vapor can escape. If vapor were to escape, this would result in a loss of liquid and thus in a correspondingly increased liquid reserve or a constant refilling of cooling liquid. Both requirements are prevented with the present invention. As a result, even when the hot cooling system cools down and there is therefore a falling below a minimum temperature, the cooling system may again be connected with the atmosphere. This prevents the occurrence of a low pressure in the cooling system.

The present invention further provides a simple way to carry out the venting as a function of the temperature with low equipment expenditures. The thermostatic valve may, for example, be made from a bimetal.

According to another feature of the present invention, air can escape and water is held back. The air exchange proper takes place via a pressure difference between the atmosphere and the cooling system at a molecular sieve.

Yet another feature of the present invention is that simultaneously a filling opening is created which corresponds to the cover in the case of conventional cooling systems operating with cooling liquid as the heat transfer medium. A separate filling opening for the coolant is unnecessary.

It is possible to integrate a pressure control valve in the cover in accordance with the features of the present invention. This creates a connection to the atmosphere which operates as a function of the pressure in addition to the connection operating as a function of the temperature.

A separating system for the liquid coolant is also formed in accordance with the present invention. By virtue thereof, it is ensured that virtually no entrained liquid reaches the vent valve and the molecular sieve.

With the expansion tank of the present invention, it is possible to construct the bottom of the expansion tank as the coolant storage space. A level indicating device that is suitable for this purpose is also provided and can be configured as a float connected with a window plate arranged in the area of the cover.

BRIEF DESCRIPTION OF THE DRAWINGS

These and further objects, features and advantages of the present invention will become more apparent from the following detailed description of a presently preferred embodiment when taken in conjunction with the accompanying drawings wherein.

DETAILED DESCRIPTION OF THE DRAWINGS

Figure 1:
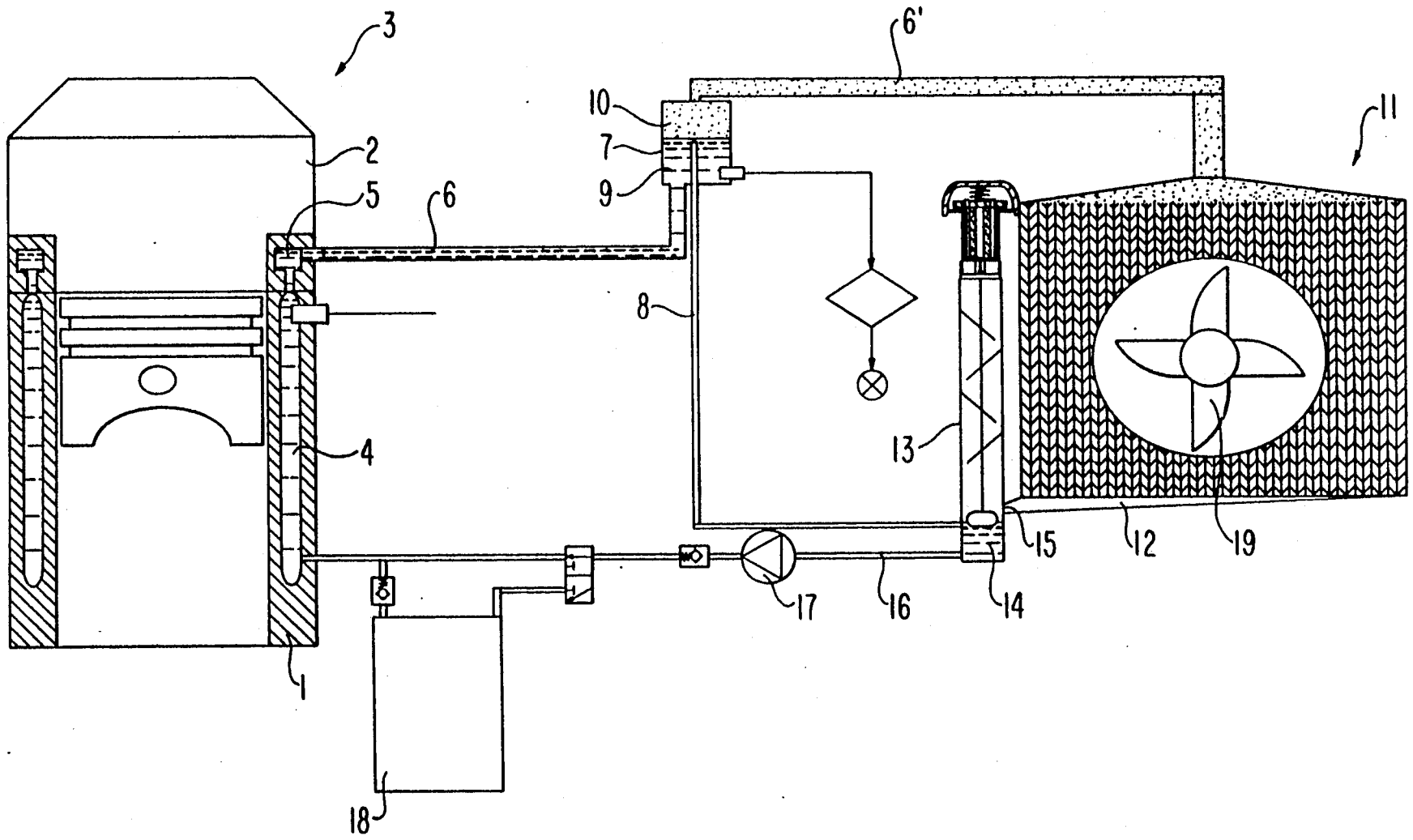
FIG. 1 is a schematic view of the evaporation cooling system according to the present invention.
Figure 2A:
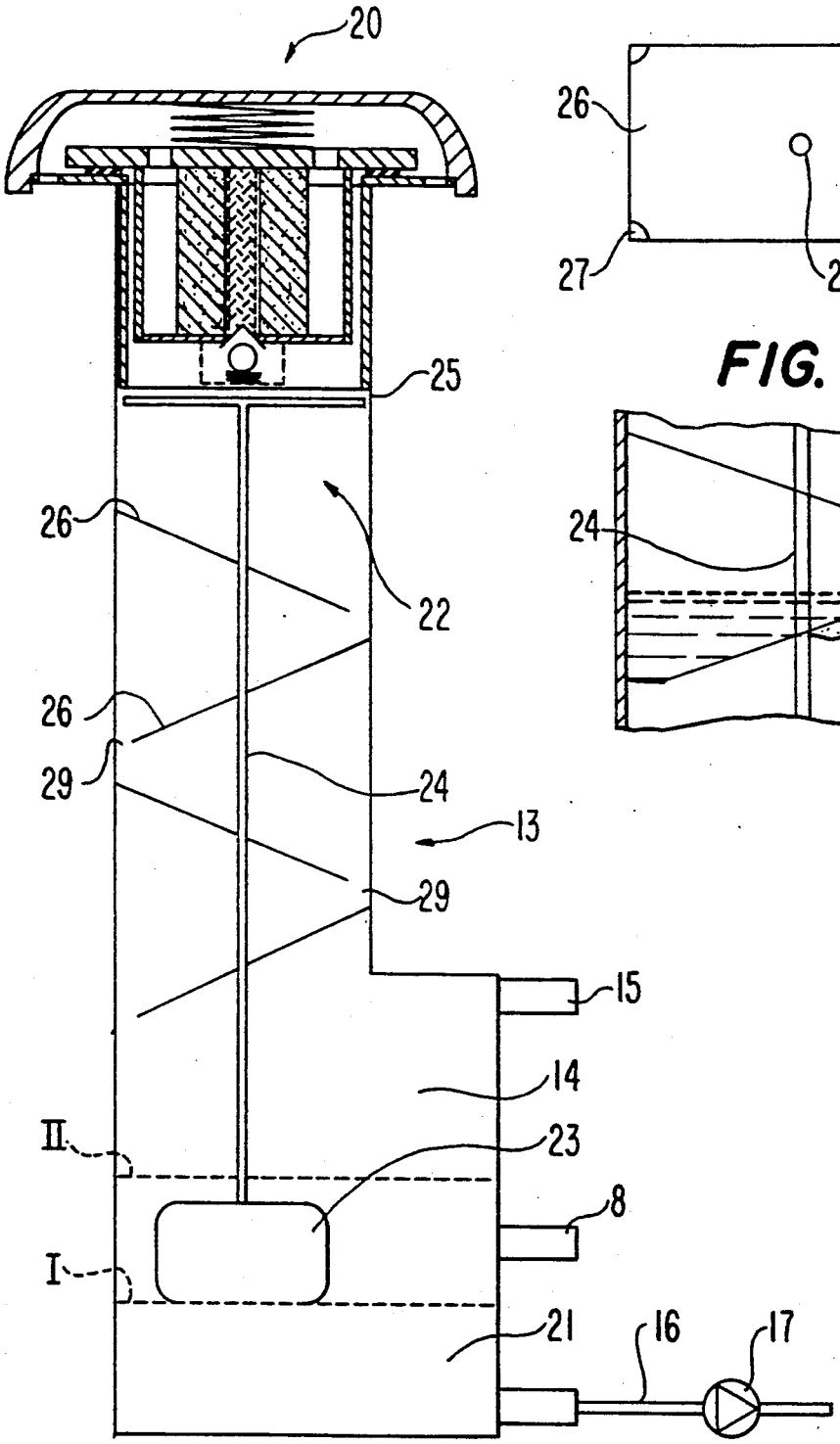
FIGS. 2*a*–2*c* are schematic longitudinal sectional views of the expansion space of the system shown in FIG. 1.
Figure 2C:
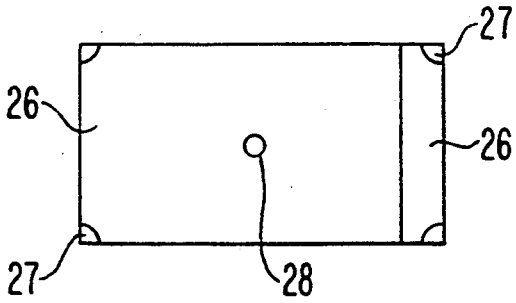
Figure 2B:
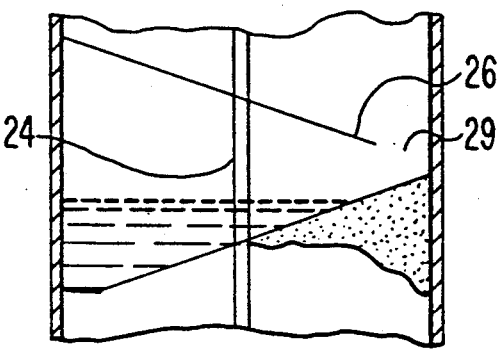
Figure 3B:
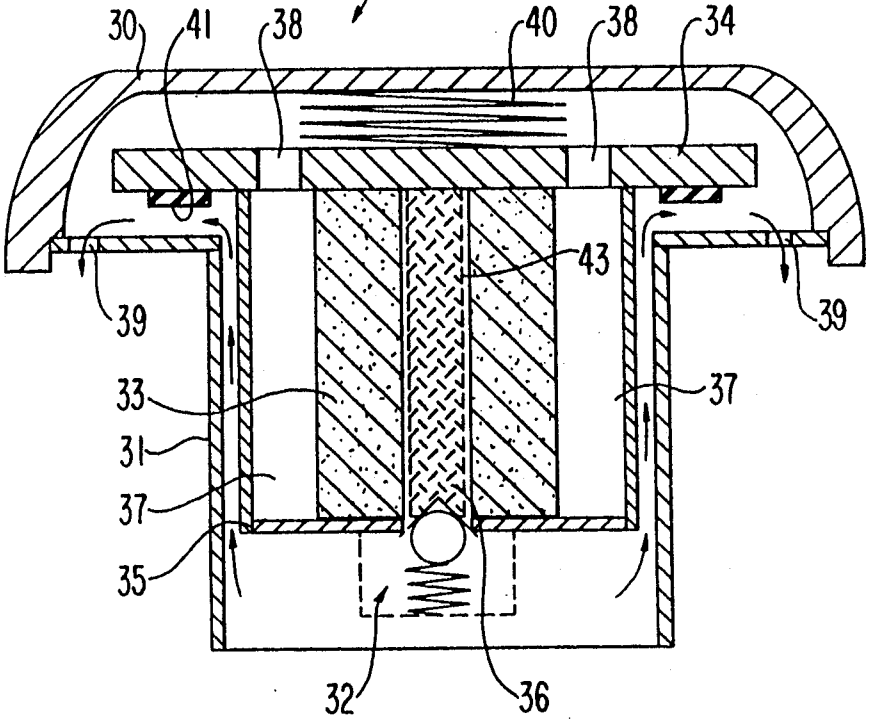
FIGS. 3*a* and 3*b* are views of two discrete conditions of the vent valve and of the pressure control valve at the upper end of the expansion space shown in FIGS. 2*a*–2*c*.
Figure 3A:
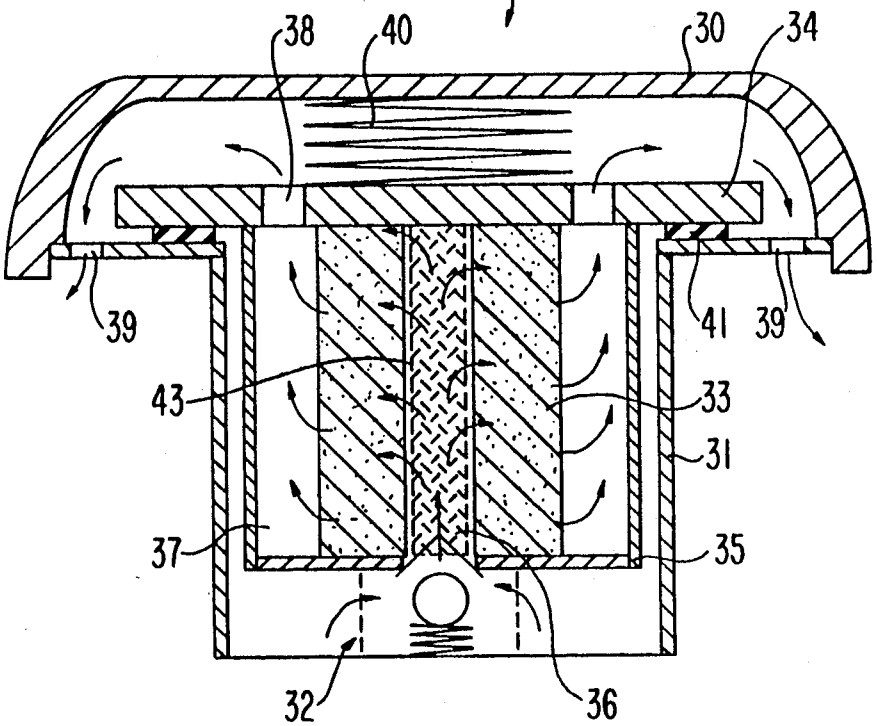

A cylinder 1 as well as a cylinder head 2 of an internal combustion engine 3 (not shown in detail) is provided with cooling ducts or cooling chambers 4, 5.

A forward-flow line 6 branches off at the highest point of the cooling chambers 5 in the cylinder head 2. A vapor separator 7 is installed into this forward-flow line 6. By means of an overflow line 8, the vapor separator 7 is divided into a lower space 9 and into an upper space 10. From the upper space 10, the forward-flow line 6' extends to a heat exchanger 11 operating as a condenser. This heat exchanger 11 has a coolant collecting portion 12 in its lower area.

An expansion tank 13 has a condensate storage space portion 14 in its lower area. This condensate storage portion 14 is connected with the coolant collecting portion 12 by way of a line 15, The overflow line 8 also leads into the storage space portion 14. By way of a condensate pump 17 and a heater heat exchanger 18, the return flow line 16 leads out of the storage space portion 14 back into the cylinder 1. The heater heat exchanger 18 is used for heating a passenger compartment of a vehicle driven by the internal-combustion engine 3.

The cooling capacity of the heat exchanger 11 may be increased by a fan 19 which takes in cooling air and presses or passes it through the heat exchanger 11.

The cylinder 1 as well as the cylinder head 2 (and in the case of multi-cylinder internal-combustion engines, all cylinders and the entire cylinder head) as well as the forward flow line 6 to space 9 of the vapor separator 7 are filled with the liquid coolant. The condensate storage space portion 14 and the return-flow line 16 with the heater heat exchanger 18 and possibly the overflow line 8 are also filled with the liquid coolant.

In the cold state of the internal-combustion engine 3, the upper space 10 of the vapor separator as well as part 6' of the forward-flow line 6 and the heat exchanger 11 as well as the expansion tank 13 are filled with air; in the hot state, they are filled with coolant vapor.

FIGS. *2a–2c* illustrate the expansion tank 13 in detail. It has an essentially tube-shaped construction and a closing cover or cap 20 fitted on its upper end. Because of the connecting line 15, it has a coolant reserve 21 in its lower area. The level of the coolant reserve is a function of the temperature. When the coolant is cold, it is at level I; when the coolant is warm, it is at level II.

A level indicator 22 is used for monitoring the coolant level. It comprises a float 23 which floats on the instantaneous coolant level and which, by way of a connecting rod 24, is connected with a window plate 25 in the area of the cover 20.

Below the cover 20, a separating labyrinth is formed in the expansion tank 13. This labyrinth consists of slanting sheets 26 which are alternately fastened to the wall of the expansion tank 13. As shown best in the top plan view of FIG. *2c*, these sheets 26 are provided with expansion bores 27 at their highest points. They also have an essentially centrally arranged bore 28 for the passage of the connecting rod 24.

The slanted sheets 26 separate the liquid coolant which, under certain circumstances, may be entrained by the air flowing to the cover 20. In this case, the expansion bores 27 prevent an air cushion from staying under the slanted metal sheets. For this reason, these expansion bores 27 are provided at the highest point of the sheets 26. The passage 29 at the lower free end of the sheets 26 ensures that the separated coolant may flow off in an unimpaired manner and it is not closed off by a capillary effect of the venting cross-sections.

The closing cover 20 is shown in detail in FIGS. *3a* and *3b*. It comprises essentially a grip portion 30 which is fixedly connected with an insert 31. A temperature-controlled vent valve 32, a molecular sieve 33 and a cover plate 34 are arranged in the insert 31. The vent valve 32 as well as the molecular sieve 33 form a structural unit which is arranged in the housing 35. The vent valve 32 which operates as a function of the temperature (e.g., a bimetal) is arranged at the inlet of the housing 35. The molecular sieve 33 is constructed as a cartridge and divides the housing 35 into a separating space 36 and a no-coolant space 37. By way of vent bores 38 in the cover plate 34, the space 37 is connected with the space enclosed by the grip portion 30 and the insert 31. From there, five circumferentially arranged bores 39 lead to the atmosphere (only two are shown in the drawings).

The cover plate 34 supports itself by a spring 40 on the interior side of the grip portion 30. With the insertion of a sealing device 41, the cover plate 34 rests on the insert 31 as shown in FIG. *3a*. The sealing device 41 is arranged such that the bores 39 always remain open. In this manner, the cover plate 34 forms a spring-loaded pressure control valve.

The operation of the expansion tank 13 constructed according to the invention will now be explained. In the cold condition, the expansion tank 13 contains ambient air. The vent valve 32 is therefore open and creates a flow connection to the atmosphere by way of the vent valve 32, the separator space 36, the molecular sieve 33, the space 37, the vent bores 38 and the bores 39 as shown in FIG. *3a*.

As soon as the internal-combustion engine 3 is operational, the water contained in the cylinder 1 and in the cylinder head 2 in coolant spaces or chambers 4 and 5 will heat up. Starting at a certain temperature, vapor will form which, by way of the vapor separator and the line section 6', flows into the heat exchanger 11. Because of the slow filling of the line segment 6' and of the heat exchanger 11 with vapor, the air contained there will be displaced into the expansion tank 13 by way of the connecting line 15. It rises through the separating labyrinth and there arrives at the opened vent valve 32. The vent valve 32 seats against support tube 43 which defines separator space 36. From there, it flows into the separator space 36 and, through the molecular sieve 33, arrives in space 37. From there, it can flow to the atmosphere by way of the vent bores 38 and 39.

As soon as the air has completely escaped from the cooling system, the coolant vapor will reach the expansion tank 13. Because of the slanted metal sheets 26 and the bores 27 as well as the distance 29, the water is separated and only vapor will reach the vent valve 32. From there, the coolant vapor flows to the atmosphere along the same path as previously the air. However, the coolant liquid contained in the coolant vapor is retained by the molecular sieve 33. The molecular sieve allows air to escape but, retains water. The air exchange by way of the sieve takes place by the pressure difference between the atmosphere and the interior of the cooling system. The separated liquid coolant will then flow back along the slanted metal sheets into the coolant reserve space 21.

As soon as the coolant vapor is sufficiently hot, for example, approximately 95° C., the vent valve 32 will shut. This prevents that coolant in the vapor-state from escaping during engine operation and the liquid level therefore falls within the cooling system.

When the internal-combustion engine 3 is switched off after operation, the vent valve 32 will gradually cool off. It will open again at a temperature of, for example, approximately 80° C. This reestablishes a connection between the cooling system and the atmosphere.

As a result of the cooling, a slight low pressure is created in the cooling system. This low pressure is such that the molecular sieve 33 again lets air flow into the expansion tank 13 and the previously vapor-filled spaces. The air exchange is concluded when the pressure is compensated between the atmosphere and the cooling system.

FIG. *3b* illustrates the condition which occurs when, while the cooling system is operative, the permissible system pressure is exceeded. In this case, the cover plate 34 together with the housing 35 will then open up against the force of the spring 40. As a result, the valve seat at the sealing device 41 is exposed and vapor can flow between the insert 31 and the housing 35 to the bores 39. As soon as the system pressure falls again, the spring 40 biases the cover plate 34, by way of the sealing device 41, back onto the insert 31. Thus, a flow connection from the expansion tank 13 to the atmosphere is again prevented.

For the first or repeated filling of the cooling system, for example, after its opening and reclosing for repair purposes, the entire cover 20 is removed. Now the coolant can be filled in through the separator space and the slanted metal sheets. The height of the coolant level is indicated by the window plate 25. Then the expansion tank 13 is closed again by the cover 20 and the cooling system will then be operational.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An evaporation cooling system for a liquid-cooled internal-combustion engine having a coolant jacket filled completely with coolant, comprising a condenser, a forward flow line operatively connected with the condenser, a vapor separator arranged at a high point in the forward-flow line to the condenser, a condensate pump arranged in a return flow line from the condenser to the cooling jacket and having a connecting line extending from the vapor separator in parallel with the condenser to the return flow line, and an expansion tank connected to the vapor space of the condenser, wherein the expansion tank, is when the coolant is cold, connected with the atmosphere and is, at an operating temperature to the coolant, disconnected from the atmosphere, a temperature-controlled vent valve is operatively arranged in the expansion tank, and a molecular sieve is arranged, as viewed in a flow direction, downstream of the vent valve.

2. The evaporation system according to claim 1, wherein the vent valve and t he molecular sieve form a structural unit and are operatively arranged in a cover closing off the expansion space.

3. The evaporation cooling system according to claim 2, wherein the structural unit is arranged in a housing fastened to a spring-loaded cover plate configured as a pressure control valve.

4. The evaporation cooling system according to claim 3, wherein vent bores provided in the cover plate are situated inside the housing and have a flow communication with the atmosphere.

5. The evaporation cooling system according to claim 2, wherein the expansion tank has a coolant reserve space at a bottom portion thereof in which a level indicator is operatively arranged.

6. The evaporation cooling system according to claim 5, wherein the level indicator comprises a float connected with a window plate arranged in proximity to the cover.

7. The evaporation cooling system according to claim 6, wherein the structural unit is arranged in a housing fastened to a spring-loaded cover plate configured as a pressure control valve.

8. The evaporation cooling system according to claim 7, wherein vent bores provided in the cover plate are situated inside the housing and have a flow communication with the atmosphere.

9. The evaporation cooling system according to claim 8, wherein the molecular sieve is a cylindrical cartridge having a center in which a supporting tube is arranged for coacting with the temperature-controlled valve.

10. The evaporation cooling system according to claim 9, wherein a separating labyrinth is provided in the expansion tank and comprises step-shaped slanted metal sheets.

11. The evaporation cooling system according to claim 10, wherein the slanted metal sheets have expansion bores at their highest point in the expansion tank.

12. The evaporation cooling system according to claim 11, wherein the metal sheets have a lower edge spaced from a wall of the expansion tank to form a gap.

13. The evaporation cooling system according to claim 12, wherein the expansion tank comprises a tube.

14. The evaporation cooling system according to claim 1, wherein the molecular sieve is a cylindrical cartridge having a center in which a supporting tube is arranged for coacting with the temperature-controlled valve.

15. The evaporation cooling system according to claim 14, wherein the vent valve and the molecular sieve form a structural unit and are operatively arranged in a cover closing off the expansion space.

16. The evaporation cooling system according to claim 15, wherein vent bores provided in the cover plate are situated inside the housing and have a flow communication with the atmosphere.

17. The evaporation cooling system according to claim 16, wherein vent bores provided in the cover plate are situated inside the housing and have a flow communication with the atmosphere.

18. An evaporation cooling system for a liquid-cooled internal-combustion engine having a coolant jacket filled completely with coolant, comprising a condenser, a forward flow line operatively connected with the condenser, a vapor separator arranged at a high point in the forward-flow line to the condenser, a condensate pump arranged in a return flow line from the condenser to the cooling jacket, and having a connecting line extending from the vapor separator in parallel with the condenser to the return flow line, and an expansion tank connected to the vapor space of the condenser, wherein the expansion tank is, when the coolant is cold, connected with the atmosphere and is, at an operating temperature of the coolant, disconnected from the atmosphere, wherein a separating labyrinth is provided in the expansion tank and comprises step-shaped slanted metal sheets.

19. The evaporation cooling system according to claim 18, wherein a temperature-controlled vent valve is operativel arranged in the expansion tank.

20. The evaporation cooling system according to claim 19, wherein the molecular sieve is arranged, as viewed in a flow direction, downstream of the vent valve.

21. The evaporation cooling system according to claim 18, wherein the slanted metal sheets have expansion bores at their highest point in the expansion tank.

22. The evaporation cooling system according to claim 18, wherein the metal sheets have a lower edge spaced from a wall of the expansion tank to form a gap.

23. The evaporation cooling system according to claim 22, wherein the slanted meal sheets have expansion bores at their highest point in the expansion tank.

24. The evaporation cooling system according to claim 18, wherein the expansion tank comprises a tube.

25. The evaporation cooling system according to claim 24, wherein the slanted metal sheets have expansion bores at their highest point in the expansion tank.

26. The evaporation cooling system according to claim 25, wherein the metal sheets have a lower edge spaced from a wall of the expansion.

* * * * *